US005373351A

United States Patent [19]

Umeda et al.

[11] Patent Number: 5,373,351

[45] Date of Patent: Dec. 13, 1994

[54] ELECTROSTATIC RECORDING APPARATUS AND MANAGING SYSTEM THEREOF

[75] Inventors: Takao Umeda, Mito; Tetsuya Nagata; Yasuo Takuma, both of Hitachi; Tatsuo Igawa, Kitaibaraki, all of Japan

[73] Assignees: Hitachi, Ltd.; Hitachi Koki Co., Ltd., both of Tokyo, Japan

[21] Appl. No.: 917,709

[22] Filed: Jul. 16, 1992

[30] Foreign Application Priority Data

Jul. 22, 1991 [JP] Japan ..... 3-204539

[51] Int. Cl.[5] ..... G03G 21/00

[52] U.S. Cl. ..... 355/208; 355/213; 355/245; 355/271

[58] Field of Search ..... 355/261, 216, 245, 246, 355/210, 211, 213, 219, 208, 212, 209, 206, 271–277, 205, 207

[56] References Cited

U.S. PATENT DOCUMENTS

| | | | |
|---|---|---|---|
| 4,076,410 | 2/1978 | Kono et al. | 355/213 |
| 4,097,138 | 6/1978 | Kingsley | 355/213 |
| 4,219,272 | 8/1980 | Brückel et al. | 355/213 |
| 5,101,234 | 3/1992 | Suzuki et al. | 355/213 |
| 5,128,719 | 7/1992 | Umeda et al. | 355/213 |
| 5,138,380 | 8/1992 | Umeda et al. | 355/213 X |

FOREIGN PATENT DOCUMENTS

| | | |
|---|---|---|
| 4940737 | 4/1974 | Japan . |
| 212571 | 1/1990 | Japan . |
| 2139583 | 5/1990 | Japan . |

*Primary Examiner*—A. T. Grimley
*Assistant Examiner*—Shuk Y. Lee
*Attorney, Agent, or Firm*—Kenyon & Kenyon

[57] ABSTRACT

A parallel circuit of a capacitor and a varistor is connected between a ground and an aluminum cap of a photosensitive drum having a photoconductor sheet wound on a surface of an aluminum drum. The capacitor is charged by a charger. A developer roll connected to a bias voltage supply is provided with a retraction mechanism and is controlled so that the developer roll is separated from the drum mechanically upon start of operation of a recording apparatus until a potential of the cap is increased to a predetermined value and a developing agent layer does not come into contact with the cap. Alternatively to retraction of the developing roll, the developing roll may be stopped to control a height of bristle of developing agent or a bias voltage of the developer may be reversed.

10 Claims, 10 Drawing Sheets

ELECTROSTATIC RECORDING APPARATUS AND MANAGING SYSTEM THEREOF

BACKGROUND OF THE INVENTION

1. Field of the Invention

The present invention relates to an electrostatic recording apparatus of electrophotographic type, and more particularly to an electrostatic recording apparatus of reversal development type using a photoconductor drum having a photosensitive material or photoconductor sheet wound on a drum surface.

2. Description of the Related Art

A conventional technique concerning an electrostatic recording apparatus using a photoconductor drum having a photoconductor sheet wound on the surface is disclosed in Japanese Patent Unexamined Publication No.49-40737 (JP-A-49-40737). This conventional technique concerns an electrostatic recording apparatus using a photoconductor sheet wound drum, in which a photoconductor sheet is drawn out from a stock roll accommodated in the drum to the outside of the drum, via an opening formed in part of the drum, to be wound on the surface of the drum and is then taken in the drum through the opening again to be wound by a take-up roll. A metal portion of a drum cap of a normal development the copying machine is connected to a ground potential and has a surface on which high resistive film such as aluminum oxidized film is formed so that toner is not attached on the surface of the drum cap.

Further, a conventional technique concerning the electrostatic recording apparatus of this type is disclosed in JP-A-2-139583, proposed by inventors including one of the inventors of the present invention. In this conventional technique, a drum cap is utilized to measure a surface potential of a photoconductor on a photoconductor drum.

Generally, in an electrostatic recording apparatus of reversal development type such as a printer, in order to prevent toner from being attached on the surface of the cap in the development it is necessary to hold a surface potential of a cap to a sufficiently higher voltage than a developing bias voltage and to form a dielectric film on a surface of a metal portion of the cap so as to reduce an image force due to electric charges of toner particles. A method of forming the dielectric film having a volume resistivity of $10^9$ cm or less on the cap surface to reduce the image force by electric charges of toner particles has been proposed in JP-A-2-12571 by inventors including three of the inventors of the present invention.

In order to hold the surface potential of the cap to the sufficiently higher voltage than the developing bias voltage, there is a method of connecting a capacitor between the cap and the ground and charging the capacitor through a charging current from a charger to apply the charged-up potential to the cap. This method has merit in that a new power supply is not required. In this method, when the volume resistivity of a dielectric film formed on the cap surface is equal to $10^9$ Ωcm or less and a thickness of the film is in a range from 20 to 100 μm, a resistance of the film is equal to 100 KΩ or less. In this case, when the resistance of the film is increased, the charging current is reduced and the charging speed is influenced. Further, a potential of the surface of the cap depends on the charging current, a charging time and a capacitance of the capacitor.

This method is now described with reference to FIGS. 12A and 12B. In FIG. 12A, numeral 1 denotes a drum, 2 a photoconductor sheet, 3-1 a stock roll, 3-2 a take-up roll, 5 a cap, 7-1 a capacitor, 7-2 a voltage control element, 10 a developer roll, 12 a developer, 13 a developing bias voltage supply, and 16 a charger. In an electrostatic recording apparatus, a photoconductor drum 4 is structured as shown in FIG. 12A. More particularly, the photoconductor sheet drawn from the stock roll 3-1 provided in the drum 1 is wound on a surface of the drum 1 made of aluminum or the like and is then wound on the take-up roll 3-2. The cap 5 made of aluminum or the like is disposed at an opening of the photoconductor drum 4. A parallel circuit 6 of the capacitor 7-1 and the voltage control element 7-2 such as a varistor is connected to the cap 5. Further, dielectric film 20-2 having a volume resistivity of $10^7$ Ωcm is formed on the surface of a metal portion 20-1 of the cap 5.

It is assumed that any electric charge is not stored in the capacitor 7-1 before start or during standstill of the electrostatic recording apparatus. When the electrostatic recording apparatus is started so that the drum begins to be rotated and the cap 5 passes under the charger 16 connected to high voltage supplies 17 and 18, a charging current through corona discharge flows to charge the capacitor 7-1. At this time, when a charging current flowing into the photoconductor drum 4 from the charger 16 is $I_d$, a charging current of the capacitor 7-1 is $I_j$, a charging time is $T_j$, and a capacitance of the capacitor 7-1 is $C_j$, a potential $V_c$ of the capacitor 7-1 (equal to a surface potential of the cap 5) is given by $$V_c = \left( \int_0^{T_j} I_j dt \right) / C_j \tag{1}$$

When a moving speed of the drum 4 is $v_d$, a width of the charger 16 is $W_c$, and a width of the cap 5 is $W_d$, the charging time $T_j$ and the charging current $I_j$ are expressed by $$T_j = W_c / v_d \tag{2}$$

$$I_j = I_d \times (W_d / W_c) \tag{3}$$

That is, the voltage $V_c$ of the capacitor 7-1 is inversely proportional to the capacitance $C_j$ of the capacitor 7-1 and the moving speed $v_d$ of the drum and is proportional to the width $W_d$ of the cap 5 and the charging current $I_d$. Accordingly, when the apparatus is operated at a high speed and the moving speed $v_d$ is increased, the charging time $T_j$ is made short and when it is considered to make the apparatus small, the width $W_d$ of the cap is also made narrow. However, it is not preferable for deterioration of the photoconductor and increased capacity of the power supply to increase the charging current $I_d$ excessively in order to charge the capacitor 7-1 rapidly.

On the other hand, as the cap 5 is apart from the charger 16, the charge stored in the capacitor 7-1 is leaked through the voltage control element 7-2 connected in parallel with the capacitor and the potential of the surface of the cap 5 is reduced. FIG. 12B shows a variation of the surface potential of the cap 5. When a time required for one rotation of the photoconductor drum 4 is $T_k$, the surface potential $V_c$ of the cap 5 is increased gradually and in a step manner while repeating its increase and reduction. In FIG. 12B, $T_c$ is a time until the cap 5 reaches the developer 12 after the cap 5 comes under the charger 16, $T_d$ is a time until the cap comes under the charger 16 again after the cap comes out from the developer 12, and $V_G$ is a voltage of a grid of the charger 16. A potential $V_B$ of the cap 5 at the time when the cap passes under the developer 12 is gradually increased to $V_{B1}$ in a first rotation, $V_{B2}$ in a second rotation, $V_{B3}$ in a third rotation and $V_{B4}$ in a fourth rotation.

When the cap potential is varied as above, some problems occur as follows:

(1) Attachment of Toner on the Cap Surface

When a bias voltage of the developer 12 is $V_D$, the potential or voltage $V_B$ of the cap is equal to or smaller than the bias voltage $V_D$ when the drum 4 is rotated three times. Accordingly, the cap 5 is developed and toner 21 is attached on the cap surface. Since the attached toner is removed by a cleaner, consumption of toner increases and scattered toner during the rotation of the drum contaminates paper and the interior of the apparatus.

(2) Electric Shock

There is a case where the photoconductor drum 4 is stopped suddenly due to a jam of paper or a failure of a printer to remove paper wound on the drum 4 or examine the drum. In this case, electric charges remain in the capacitor of the cap even after a time $T_D$ from stop of the drum 4 and the surface potential of the cap is $V_j$. Accordingly, when the potential $V_j$ is high, an electric shock occurs due to contact with the cap 5.

(3) Influence of Step between the Cap and the Photosensitive Drum

Since there is a step between the surface of the cap 5 and the surface of the photoconductor drum 4, i.e., the cap is at a different outer radius with respect to the center of the drum than the surface of the drum there is a case where a flaw is produced on the surface of a belt pressed on the drum 4 by a roller when a belt transfer system is employed. Accordingly, there is a possibility that image quality is degraded and the belt is deteriorated. Further, there is a problem in view of retention of a uniform developing gap.

SUMMARY OF THE INVENTION

It is an object of the present invention to solve the above problems in the conventional techniques by providing an electrostatic recording apparatus including a photoconductor drum having a photoconductor sheet wound on a drum surface and capable of preventing toner from being attached on a cap surface or electric shock from occurring and of effecting recording with high image quality, as well as effective utilization of a drum cap in a diagnosis of a state of the electrostatic recording apparatus.

In order to attain the above object, the electrostatic recording apparatus includes:

- a photoconductor drum having a cap provided at an opening thereof and a photoconductor sheet wound on a portion of the drum except the opening, the cap and the photoconductor sheet of the photoconductor drum being charged while the drum is rotated;
- a potential detecting section for detecting a potential of the cap; and
- a development control section responsive to the potential detected by the potential detecting section for controlling attachment of toner particles on the wound photoconductor sheet.

According to the present invention described above, the following advantageous effects can be attained.

(1) In the electrostatic recording apparatus of reversal development type using the photosensitive or photoconductor drum on which the photoconductor sheet is wound, when the surface potential of the cap provided to the photoconductor drum is lower than a developing bias voltage, toner can be prevented from being attached on the surface of the cap. Further, as methods of realizing this measure, there are proposed a method of retracting the developer mechanically and a method of electrically controlling the developing bias voltage, and these methods can be selected in accordance with a machine specification.

(2) A DC voltage of −700 to −900 volts is applied to a capacitor connected to the cap during operation of the electrostatic recording apparatus. The substantially same voltage is applied thereto heretofore when the electrostatic recording apparatus is stopped in repairing of a jam of paper or exchanging of the drum. In the present invention, however, since electric charge of the capacitor can be removed immediately when the apparatus is stopped, electric shock does not occur even if an operator comes into contact with the cap. By employing a sequence in which an openable signal of a door is issued after removal of electric charge, improvement of safety can be further attained.

(3) Although electric charge of the capacitor connected to the cap is removed when the photoconductor drum is stopped, since the cap portion is stopped to be opposite to the charger, the capacitor can be rapidly charged by the charger when the photoconductor drum is started again after recovery of a failure and the surface potential of the cap can be made substantially equal to the surface potential of the photoconductor of an unexposed portion rapidly. Accordingly, a restarting or restoring time can be made short. In this connection, several seconds to several tens of seconds are required for the restarting time in conventional devices heretofore, while the restarting time can be reduced within one second in the present invention.

(4) Since the surface potential of the cap is monitored by a surface potential measuring portion, the series of countermeasures described above can be implemented certainly in accordance with the measured value.

(5) In the electrostatic recording apparatus using the photoconductor sheet wound type photoconductor drum and the belt transfer type, a transfer belt can be prevented from being pressed on a step between the cap and the drum. Generally, the belt is pulled by a fixed tension. Accordingly, when the belt is flawed the transfer operation fails and the belt is cracked and cut. On the other hand, in the present invention, since there is no disadvantage that the belt is flawed, the problem can be solved.

(6) Since a gap between a developer roll and the photoconductor, that is, a developing gap can be made uniform, the noncontact development characteristic necessary for the high-speed color development can be improved.

(7) Since a current flowing in the transfer belt or a developing agent layer can be measured using the cap of the drum as a current detecting electrode, the life of the transfer belt and the developing agent and an amount of paper powder contained in the developing agent can be estimated.

(8) Since information such as a current flowing from the transfer belt for estimating the life of the transfer belt and a current flowing from the developing roll for estimating the amount of paper powder in the developing agent can be collected from a plurality of electrostatic recording apparatuses to a central information processing apparatus through a communication line, exact judgment and optimum countermeasure for situation can be implemented for each of the electrostatic recording apparatuses by performing analysis of the information, statistical processing and comparison with respective past data for each of the apparatuses.

DETAILED DESCRIPTION

An electrostatic recording apparatus according to the present invention will be now described in detail with reference to the accompanying drawings.

Figure 1:
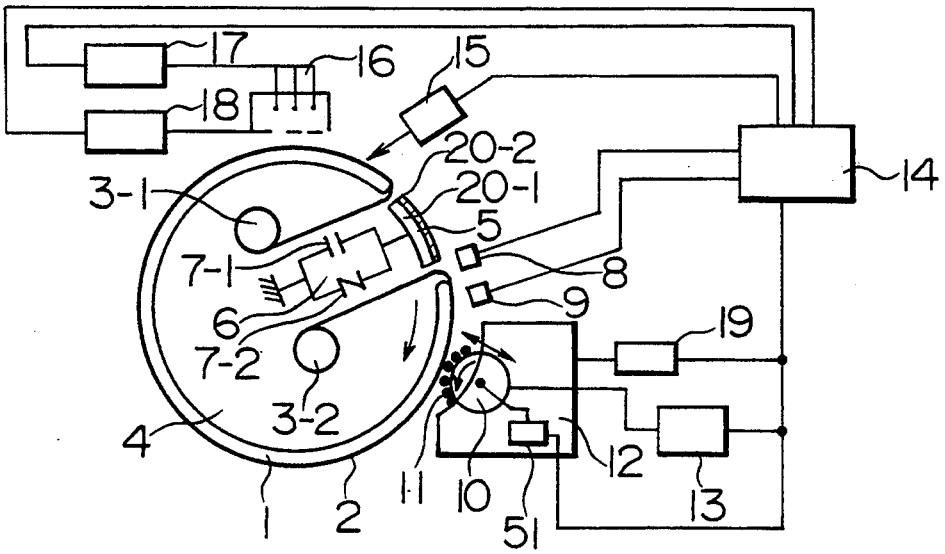
FIG. 1 schematically illustrates an electrostatic recording apparatus of the present invention in which a developer is retracted.
Figure 12A:
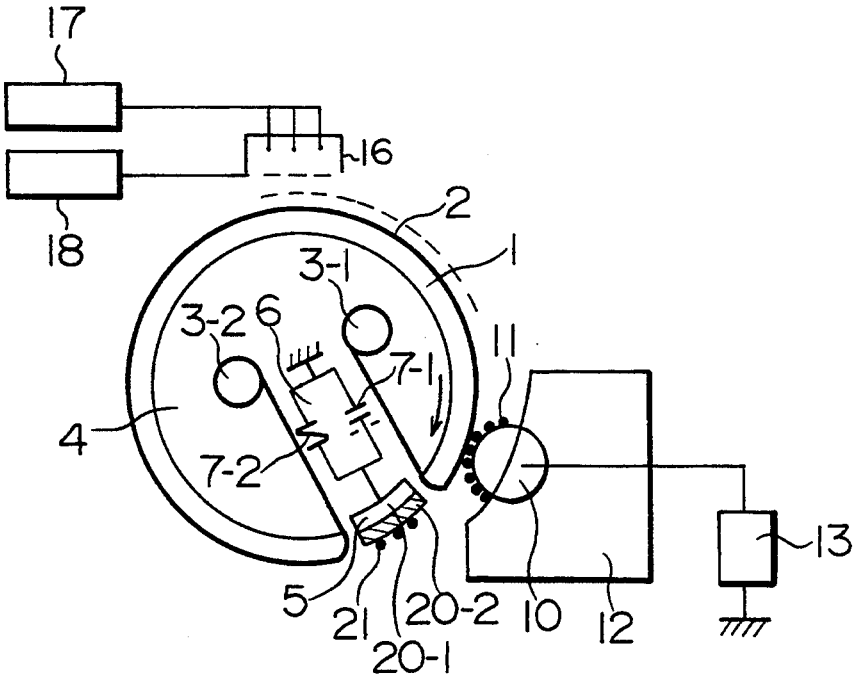
FIGS. 12A and 12B schematically illustrate a conventional method of charging a capacitor by a charging current from a charger to apply a potential to a cap.
Figure 12B:
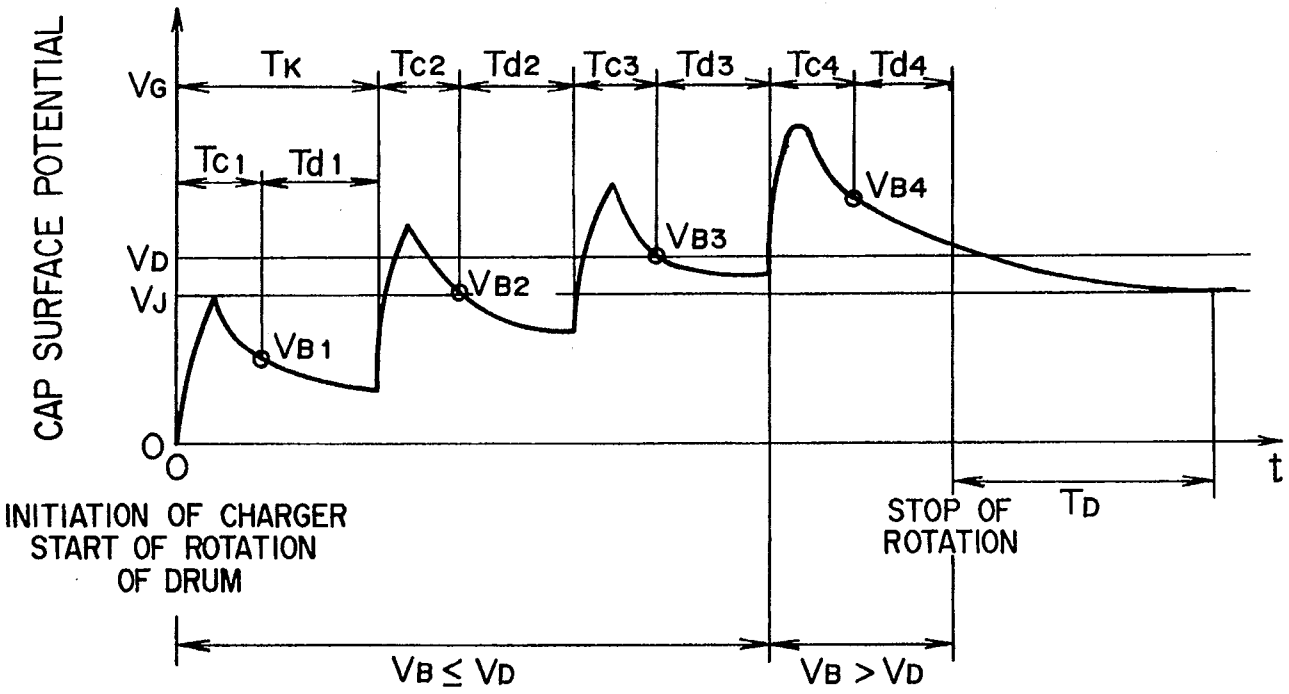

FIG. 1 schematically illustrates an electrostatic recording apparatus according to an embodiment of the present invention. In FIG. 1, numeral 8 denotes a detector for detecting a position of a cap, 9 a detector for detecting a surface potential, 14 a controller, 15 an exposure unit, 19 a retracting mechanism, and other reference numerals designate the same elements as those of FIG. 12. In the embodiment, the developer roll 10 is retracted so that a developing agent 11 is not attached to the cap 5 until a potential of the cap 5 is increased to a predetermined value.

In the embodiment of the present invention shown in FIG. 1, a parallel circuit 6 of a capacitor 7-1 and a varistor 7-2 is connected between a ground and the cap 5 of aluminum disposed in the opening of a photoconductor drum 4 including a drum 1 of aluminum having a surface on which the photoconductor sheet 2 is wound. An aluminum enameled film 20-2 having a volume resistivity of $10^9\ \Omega$ or less is formed on a surface of a metal portion 20-1 of the cap 5. Formation of the dielectric film 20-2 on the cap surface is described in U.S. Pat. No. 5,128,719, filed on Jan. 16, 1991 by Umeda, Nagata and Ikawa of the inventors of the present application and now allowed. This application is incorporated herein by reference. The charger (scorotron) 16 includes corona wires and a grid to which high voltages of the high voltage supplies 17 and 18 are applied in accordance with an instruction from the controller 14, respectively. The photoconductor sheet 2 and the capacitor 7-1 are electrified or charged by corona charge produced by the charger 16. The position detector 8 detects a position of the cap 5 of the drum 4 and the potential detector 9 detects a surface potential of the cap 5 to apply the respective detection signals representative of detected results to the controller 14.

The developing roll 10 provided in the developer 12 and having a surface on which a developing agent layer 11 is formed is applied with a bias voltage from the bias voltage supply 13 in accordance with an instruction from the controller 14. The retracting mechanism 19 is coupled with the developer 12 and a position of the developer 12 is controlled in accordance with an instruction from the controller 14. More particularly, the controller 14 monitors a potential $V_B$ of the surface of the cap 5 by the detector 9 provided in the vicinity of an entrance or inlet of the developer 12. The retracting mechanism 19 is operated to retract the developer 12 and as a result the developing roll 10 so that the developing agent layer 11 does not come into contact with the cap surface until the potential $V_B$ is increased to a predetermined value, for example, a sufficiently larger value than a voltage $V_D$ of the bias voltage supply 13. Thus, attachment of toner to the surface of the cap 5 can be prevented. If the retracting operation is canceled when the potential $V_B$ exceeds the potential $V_D$, the recording apparatus can perform the normal recording operation thereafter.

In the foregoing description, the predetermined value for the surface potential of the cap 5 may be selected to be substantially the same value as the surface potential of an unexposed portion of the photoconductor. Further, the developing agent used may be any of one component developing agent using only toner or two-component developing agent using toner and carrier.

Figure 2A:
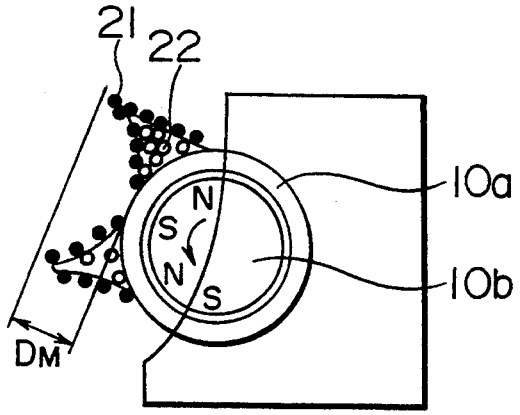
FIGS. 2A and 2B schematically illustrate controlled height of bristle.
Figure 2B:
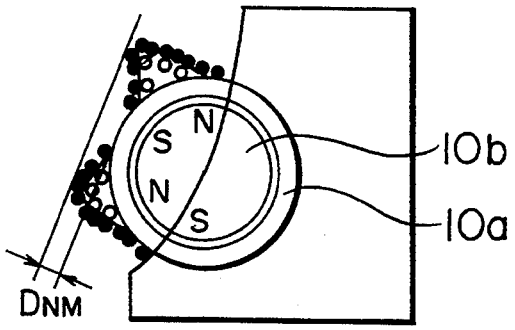

As shown in FIGS. 2A and 2B, when the two-component developing agent including toner 21 and carrier 22 is employed, the developing roll 10 includes a sleeve roll **10*a* and a magnetic roll 10*b*. The developing agent is fed to a developing position through rotation of the sleeve roll 10*a*. A height $D_M$ of the developing agent at the developing position at this time is called a height of bristle. The height $D_M$ becomes to be a height $D_{NM}$ when the developing roll is stationary. The nature of the height of bristle of the above developing agent is employed to control rotation of the developing roll 10 so that the developing agent comes into contact with the photoconductor 2 when the developing roll is rotated and the developing agent does not come into contact with the photoconductor 2 when the developing roll 10 is stationary. More particularly, the controller 14 monitors the potential $V_B$ of the surface-of the cap 5 and controls a roll rotation driving section 51 to stop rotation of the developing roll 10 until the potential $V_B$ is increased to a predetermined value, for example, a sufficiently larger value than the voltage $V_D$ of the bias voltage supply 13. Thus, attachment of toner to the surface of the cap 5** can be prevented.

In this connection, when a necessary time (necessary rotational number) for increasing the surface potential $V_B$ of the cap 5 to be larger than the potential $V_D$ is predetermined, the rotation driving section 51 may be controlled to stop rotation of the developing roll until the necessary time (necessary rotation) elapses after rotation of the drum 4 has been started.

Figure 3A:
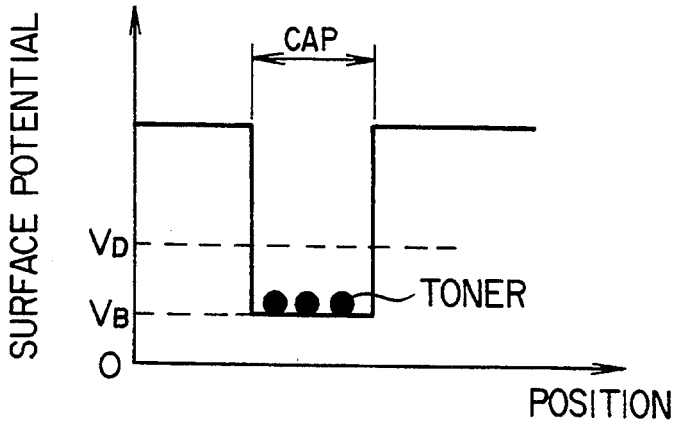
FIGS. 3A and 3B schematically illustrate a controlled bias voltage of a developer.
Figure 3B:
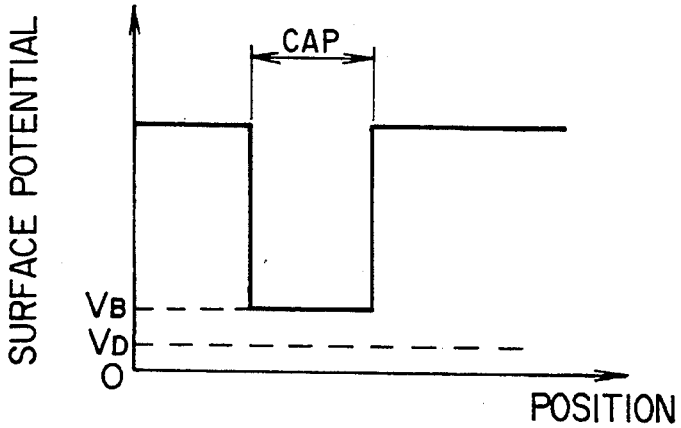

When the Teflon resin film 20-2 (volume resistivity of $10^8$ Ωcm) having carbon added thereto is formed on the surface of the cap 5, the volume resistivity of the film 20-2 can be varied by changing an amount of added carbon. In the case of the reversal development system, when the developing bias voltage $V_D$ is higher than the surface potential $V_B$ of the cap, toner is attached to the surface of the cap. FIG. 3A shows the fact that toner is attached to the surface of the cap having the potential $V_B$ in the case of $V_D > V_B$ and FIG. 3B shows the fact that toner is not attached to the surface of the cap having the potential $V_B$ in the case of $V_D < V_B$.

The capacitor 7-1 connected to the cap 5 is charged by the current flowing into the cap 5 from the charger 16. The controller 14 monitors the charged potential of the unexposed portion of the charge receiving surface of the photoconductor sheet 2 and the surface potential $V_B$ of the cap 5 by means of the detector 9 and sets the developing bias voltage $V_D$ to a sufficiently lower value than the potential $V_B$ of the surface of the cap 5 until the surface potential $V_B$ is substantially equal to the charged potential of the unexposed portion of the charge receiving surface of the photoconductor 2. That is, the bias voltage supply 13 is controlled to make reverse bias. Thus, attachment of toner to the surface of the cap can be prevented.

A method of removing electric charges stored in the capacitor 7-1 connected to the cap 5 will be now described.

Figure 4:
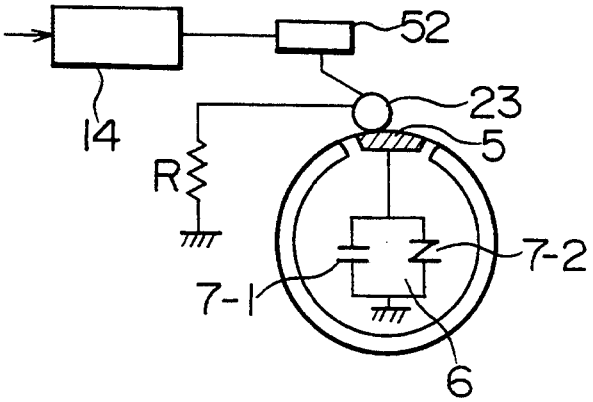
FIG. 4 schematically illustrates discharge of electric charges from a cap.

As shown in FIG. 4, upon stop of the drum 4, a contactor 23 connected to a ground potential is brought into contact with the cap 5 by a contactor driver 52 in accordance with an instruction from the controller 14 to remove or discharge electric charge stored in the capacitor 7-1. The contactor 23 is usually retracted by the driver 52 and when there is a possibility that a human body comes into contact with the photoconductor drum 4 for the purpose of repair of a jam of paper, exchange of the drum or the like, the driver 52 is controlled in accordance with a discharge control signal from the controller 14 generated on the basis of signals such as a signal from a safety switch or the like or an instruction signal from a user so that the contactor 23 is brought into contact with the cap 5. In this case, it is necessary to stop the cap at a position in which the cap is opposed to the contactor 23 when the drum is stopped. In order to prevent occurrence of electric spark upon the contact, a resistor may be connected between the contactor 23 and the ground. However, as in the embodiment, when the hard dielectric film 20-2 such as an aluminum oxidized or aluminum enameled film is formed on the surface of the cap 5, a new resistor is not required.

Figure 5A:
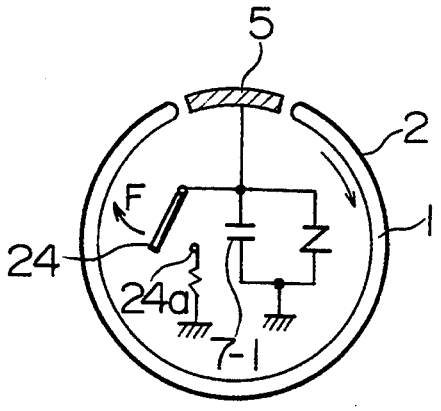
FIGS. 5A and 5B schematically illustrate a method of controlling discharge of electric charges of a capacitor by utilizing centrifugal force.
Figure 5B:
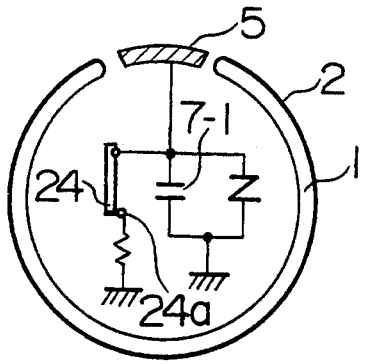

As another method of discharging electric charge of the capacitor 7-1 automatically, as shown in FIGS. 5A and 5B, there is provided a contact shoe 24 having one end electrically connected to the cap. As shown in FIG. 5A, the contact shoe 24 is separated or apart from a ground terminal **24*a* with centrifugal force F during rotation of the drum. When the drum is stopped, the contact shoe 24 comes into contact with the ground terminal 24*a* as shown in FIG. 5B to remove the electric charge of the capacitor 7-1. In this case, the electric charges can be discharged exactly by pulling the contact shoe 24 in the opposite direction to the centrifugal force F by a spring having relatively weak force even if the drum 4** is stopped at any position.

Figure 6:
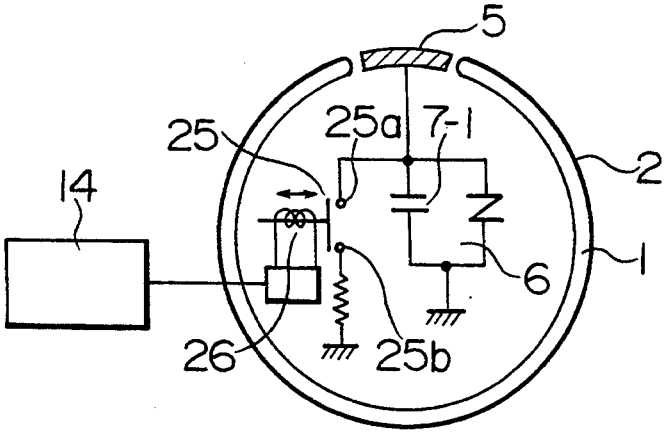
FIG. 6 schematically illustrates a method of controlling discharge of electric charges of the capacitor by an external instruction by means of a switch.

In a method shown in FIG. 6, a magnet switch 26 is disposed within the drum 4 and one end of a switch terminal is connected to the cap 5 through a contact **25*a* with other end thereof being connected to the ground through a contact 25*b* and a resistor. When the drum 4 is stopped, a current flows in the magnet 26 in response to an instruction from the controller 14 so that the switch terminal 25 connects between the cap 5 and the ground and electric charge stored in the capacitor 7-1 is removed. This example has merit that the electrical control can be more easily made as compared with the methods shown in FIGS. 4, 5A and 5B**.

The methods of FIGS. 4 and 6 of the present invention described above can be performed in response to a request for removal of electric charges upon repair of a jam of paper and exchange of the drum. After a fixed period of time from issuance of the request has elapsed, a signal indicating that the door of the apparatus is operable can be sent to a monitor to display that removal of electric charges has been completed. More certainly, the surface potential of the cap is measured by the detector 9 and after it is confirmed that the measured value is reduced to a sufficiently low value so that electric shock does not occur even if a human being comes into contact with the cap, the openable signal may be sent to the monitor of the electrostatic recording apparatus. Further, the openable signal can be sent to an information processing apparatus such as, for example, a computer, a word processor, a personal computer and a work station using the electrostatic recording apparatus so that the openable signal can be displayed in a display unit thereof.

Figure 7A:
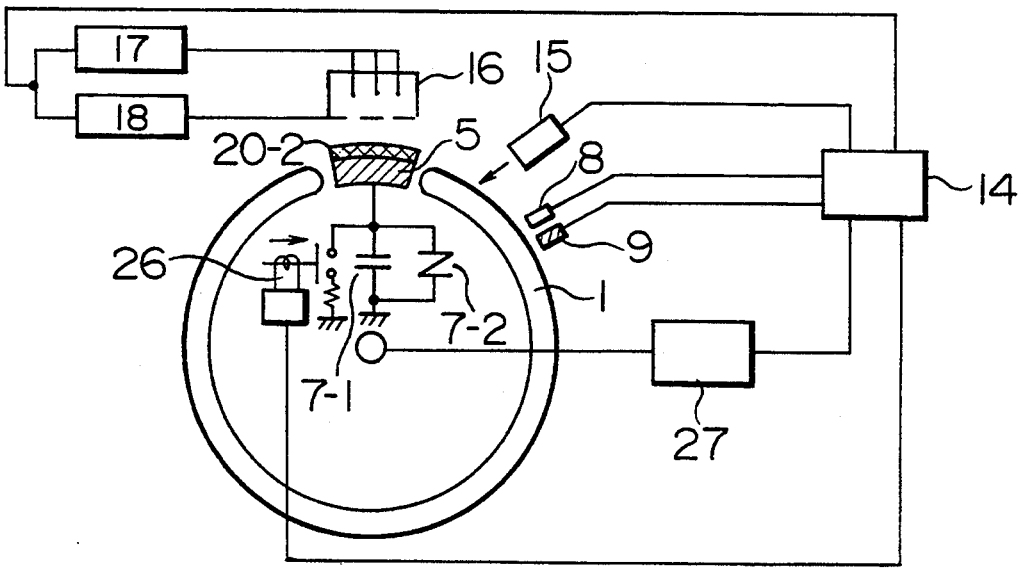
FIGS. 7A and 7B schematically illustrate a method of shortening a charging time of the cap by controlling a stop position of a drum.
Figure 7B:
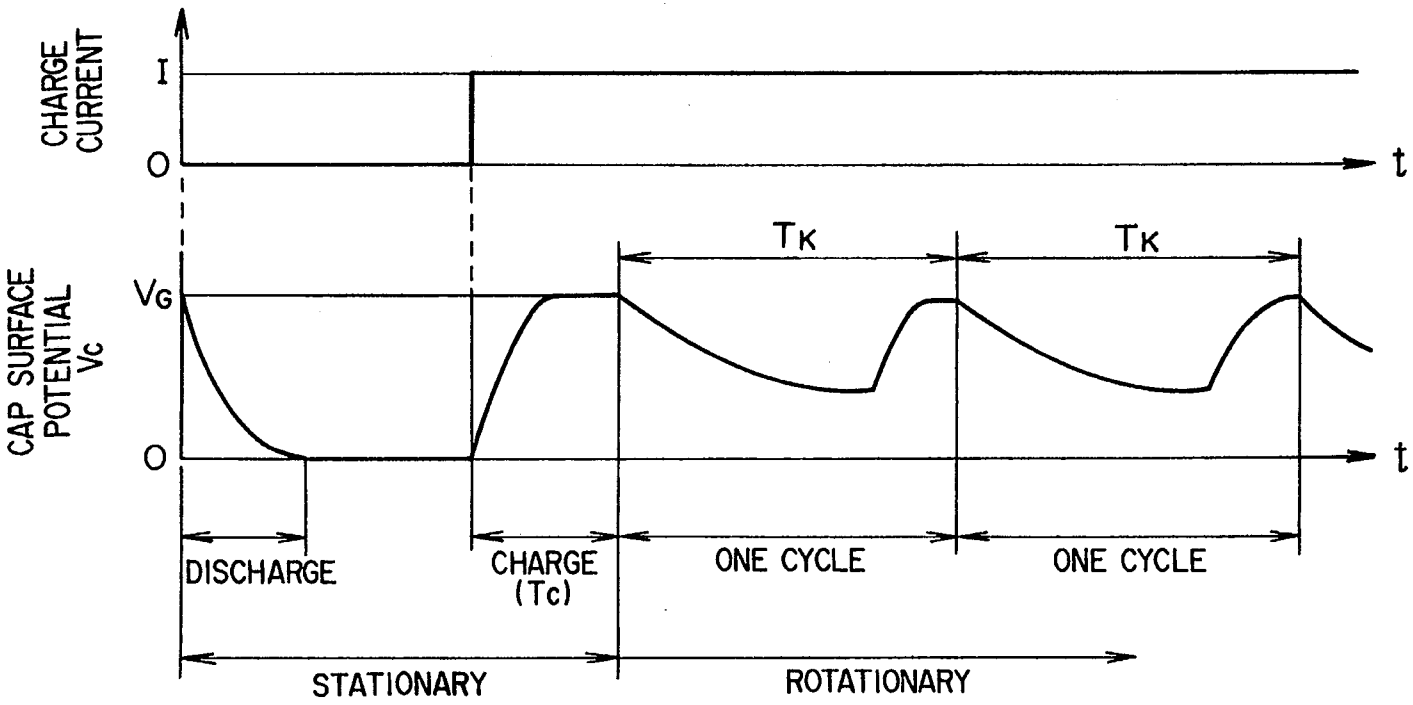

In an example shown in FIGS. 7A and 7B, a method of controlling discharging and charging of the capacitor 7-1 connected to the cap 5 is shown. As shown in FIG. 7A, it is assumed that instructions for repair of a jam of paper or exchange of the drum are sent from the controller 14 to a controller 27 for a drive motor of the photoconductor drum 4 and the charger power supplied 17 and 18 and rotation of the drum drive motor and operation of the charger are stopped. At this time, the drum 4 is stopped in accordance with a detected result of the position detector 8 so that the cap 5 is positioned under the charger 16. A current then flows into the magnet switch 26 and the contactor 25 connects between the cap 5 and the ground terminal so that electric charge stored in the capacitor 7-1 is discharged.

When the repair of jam of paper or the exchange of the drum has been completed and the apparatus is instructed to initiate its operation, electric power is supplied to the charger 16 from the power supplies 17 and 18 so that the charger 16 initiates corona discharge. Thus, a discharge current $I_d$ flows in the cap 5 to charge the capacitor 7-1. The cap potential $V_c$ is increased to a predetermined potential after an elapse of a fixed time $T_C$. This potential is determined by a grid voltage and a varistor voltage. Then, the drum 4 begins to be rotated and the printing operation is started.

In this example, since the capacitor is controlled to be charged before the start of rotation of the drum as described above, the cap can be charged rapidly and a return to the printing operation can be made more quickly. In this case, it is also possible to return to the printing operation after the surface potential of the cap 5 has been confirmed by means of the potential detector 9, that is, after one rotation of the drum 4. Since the exposure is made after the cap 5 has passed through the exposure unit 15, when a rotation period of the drum is $T_k$, the potential of the cap 5 is never reduced to the bias voltage or less of the developer 12 during its operation though the cap potential is changed as shown in FIG. 7B by repeated self-discharge through the varistor 7-2 and charge by the charger. In this example, since the cap 5 is stopped under the charger 16 and the capacitor 7-1 is charged, a width of the cap 5 is required to be wider than that of the charger 16 in order to prevent the photoconductor 12 from being damaged, and this configuration is suitable for such an electrostatic recording apparatus.

Figure 8:
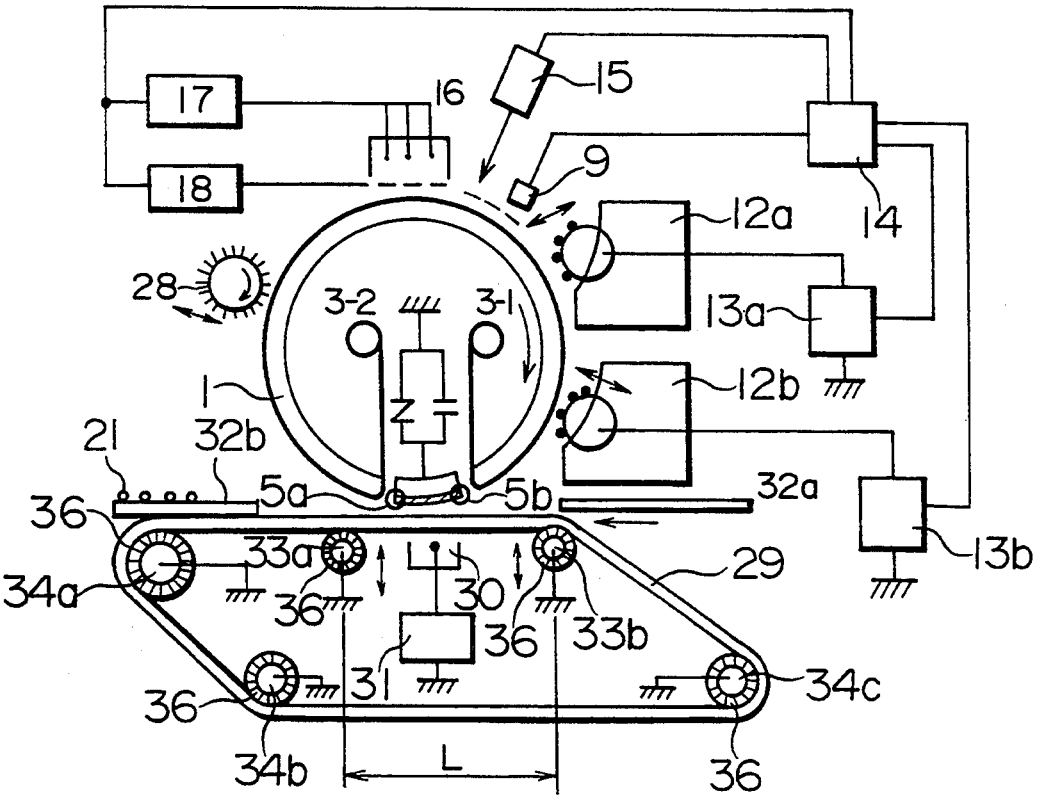
FIG. 8 schematically illustrates an electrostatic recording apparatus of belt transfer type capable of effecting two-color printing.

Referring now to FIG. 8, an electrostatic recording apparatus using the photoconductor drum of photoconductor sheet wound type and a belt transfer system will be described. The electrostatic recording apparatus includes two developers 12*a* and 12*b* and can effect two-color printing by two rotations of the photoconductor drum 4. In FIG. 8, the developers 12*a* and 12*b* are configured such that rotation of the developer roll 10 or to control the developer bias voltage is controlled or that the developers 12*a* and 12*b* can be retracted. The printing operation is started when the potential of the cap 5 reaches a sufficiently high value which is substantially equal to the surface potential of the photoconductor 2.

Development for the first color is made by the first developer 12*a* and a toner image of the first color is formed on the photoconductor 2. Though the photoconductor drum 4 is rotated and passes under the second developer 12*b*, a transfer belt 29 and a cleaner 28, since these units are retracted, the toner image of the first color is not scratched off and the photoconductor drum 4 passes under the charger 16 again to be charged. Then, after an exposure for the second color has been made by the exposure unit 15, the photoconductor drum 4 passes under the retracted first developer 12*a* and a toner image of the second color is formed by the second developer 12*b* returned from the retracted state. Thus, the two-color toner image is formed on the photoconductor drum 4 with two rotations of the photoconductor drum as described above. Thereafter, the retracted transfer belt 29 is released from its retracted state under control of the controller 14 and a sheet of paper 32*a* is pressed on the photoconductor drum 4 so that the toner image is transferred onto the sheet of paper 32*a*. In this case, the development for the second color is made in the noncontact manner by the second developer 12*b* in order to prevent color mixture. It is preferable that rotation of the developer roll of the retracted developer is stopped in order to prevent scattering of carrier. In addition, the development order may be changed so that the development for the first color is made by the second developer and the development for the second color is made by the first developer.

In the foregoing description, a charger 30 serves to apply electric charge to the transfer belt 29 and is connected to a DC voltage supply 31 having the opposite polarity to that of toner. This example includes a removing unit of remained electric charge on the transferred paper, a cleaner of the belt and the like in addition to the above-described units, while these are omitted in FIG. 8.

In order to transfer the toner image on the photoconductor 2 to the paper, the transfer belt 29 retracted in the first rotation of the photoconductor drum 4 is required to be pressed onto the photoconductor drum 4 by press rollers 33*a* and 33*b* to thereby secure a nip region of the drum and the belt. In order to avoid the transfer belt 29 from being flawed by the cap 5, it is necessary that the press rollers 33*a* and 33*b* do not press ends 5*a* and 5*b* of the cap through the transfer belt 29, that is, the transfer belt 29 is not pressed onto the cap 5 during passage of the cap 5. As methods therefor, the following two methods can be used.

(1) A distance L between the press rollers 33*a* and 33*b* is made wider than the width of the cap 5. In other words, a width of the nip region is made wider than the width of the cap 5.

(2) When passage of the end 5*b* of the cap 5 through a position of the press roller 33*a* is detected by the controller 14 on the basis of an output of the position detector 8 and an output of the controller 27 of the drive motor of the drum 4, the retracting mechanism (not shown) is operated in response to an instruction from the controller 14 to press the transfer belt 29 onto the photoconductor drum 4 by means of the press rollers 33*a* and 33*b*. As a result, it can be prevented by the above methods to press the press rollers 33*a* and 33*b* to the edge portions of the cap 5 through the transfer belt 29. Thus it can be prevented to damage the belt 29 mechanically by a gap or a step between the metal drum 1 and the cap 5.

Figure 9:
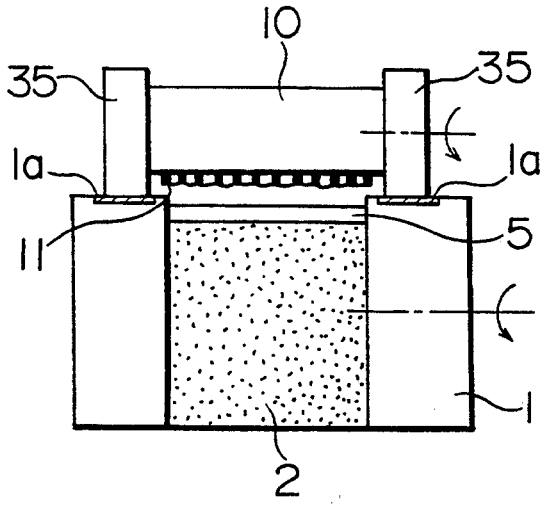
FIG. 9 schematically illustrates a developer capable of effecting noncontact development.

FIG. 9 schematically illustrates a shape of the drum 4 and the developer 12 for securing the developing gap. Hereinafter, when a toner image of a plurality of colors is formed on the photoconductor drum 4, the developer 12*b* for the second color and the subsequent color uses a noncontact developer. In the case of the noncontact development, it is necessary to maintain a predetermined distance or gap between the surface of the developer roll 10 and the surface of the photoconductor 2. This distance is about 0.05 to 0.3 mm for one-component developing agent and about 0.1 to 0.5 mm for two-component developing agent.

In the electrostatic recording apparatus of the present invention, in order to secure the distance between the surface of the developer roll 10 and the surface of the photoconductor 2, a roller 35 for defining the gap is provided to the developing roller 10 of the developer 12. Further, since the cap 5 of the drum 4 is detachable, there is a case where a step is formed between the drum 4 and the cap 5. Accordingly, in order to prevent the roller 35 from being influenced by the step when the roller 35 is moved on the cap 5 a length of the drum 1 is made longer than that of the cap 5. Furthermore, when the surface of the cap 5 is projected above the surface of the drum 4, the surface of the developing roller 10 is flawed and accordingly the surface of the cap 5 is depressed 0.1 to 0.5 mm lower than the surface of the drum 4 in order to prevent the developing agent layer from coming into contact with the cap 5.

On the other hand, since the roller 35 is rotationally moved on the surface of the end of the drum 1, the uniformity of the gap is reduced if toner or carrier is attached to a contact portion of the drum 1 and the roller 35. Particularly, since toner and carrier scattered from the developer have electric charges, if such charged toner or carrier is attached on the metal portion such as the drum 1, mirror force acts greatly and it is difficult to remove the attached toner or carrier. For this reason, dielectric film 1*a* is formed on the surface of at least an area of the drum 1 on which the roller 35 is moved. When material of the drum 1 is aluminum, the dielectric film la can be formed through an alumite treatment. Alternatively, aluminum enameled film may be formed. Similarly, dielectric film can be formed on the surface of the belt press rollers 33*a* and 33*b* and the belt drive roller 34*a* and 34*b* to prevent attachment of toner or carrier to these rollers. Thus, a phenomenon whereby the carrier is scattered between the belt and the rollers damages the belt can be prevented. The dielectric film used here may be of a low dielectric constant and its volume resistivity may be high or may be as low as that of the dielectric film formed on the surface of the cap.

As shown in FIG. 8, a sheet of paper 32*b* having a toner image 21 transferred thereon is carried by means of the transfer belt 29, separated at a position of the drive roller 34*a*, and fed to a fixer not shown. When the sheet 32*b* is separated from the belt, there is a problem that the toner of the image 21 is scattered from the sheet 32*b* since electric discharge is generated in the gap between the sheet and the belt (separation discharge). However, when the dielectric film is formed on the surface of the drive roller 34*a*, an electric field within the gap between the sheet 32*b* and the belt 29 can be reduced and consequently the separation discharge can be removed since the dielectric film possesses an effect of a capacitor. Thus, scattering of toner can be prevented and deterioration of image and contamination in the apparatus are removed.

Figure 10:
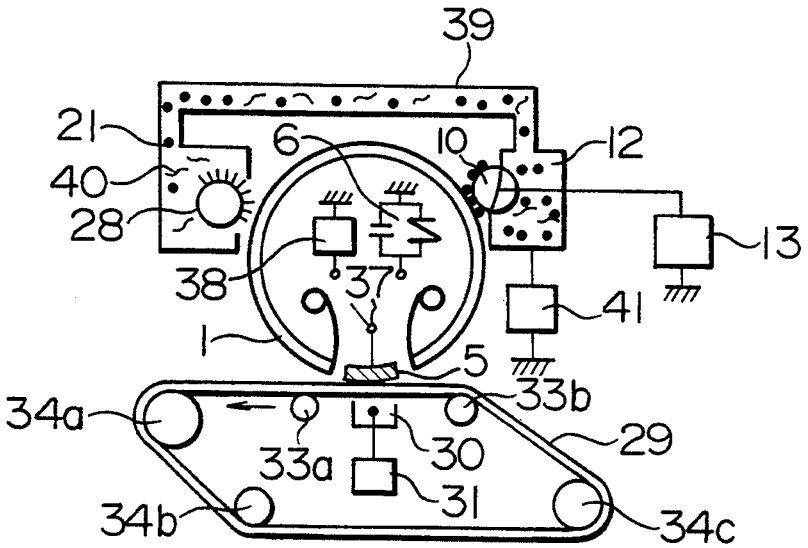
FIG. 10 schematically illustrates a method of withdrawing toner and examining a state of withdrawn toner.

FIG. 10 schematically illustrates an electrostatic recording apparatus having the cap 5 of the drum 4 serving as a current detection electrode. In FIG. 10, the parallel circuit 6 of the capacitor 7-1 and the varistor 7-2 and a current detection circuit 38 are provided within the drum 1 in the same manner as the above-described example. A switch 37 is provided between the cap 5 and these circuits 6 and 38 and the switch 37 switches connection of the current detection circuit 38 and the parallel circuit 6 in response to an instruction from the controller 14. The switch 37 usually connects the parallel circuit 6 to the cap 5, while when the cap 5 is used as the current detection electrode, the switch 37 connects the current detection circuit 38 to the cap 5. In the example shown in FIG. 10, the cap 5 is brought into contact with the transfer belt 29 so that a current flowing in the cap 5 through the transfer belt 29 from the charger 30 is detected. The detected result is supplied to the controller 14.

Usually, since the transfer belt 29 is subjected to the corona discharge during operation and is worn mechanically, the transfer belt 29 is deteriorated and its resistance is reduced. Accordingly, if the current detection circuit 38 is connected to the cap 5 periodically and the current flowing in the cap 5 through the transfer belt 29 from the charger 30 is detected, the detected current value is increased due to deterioration of the transfer belt 29. The current detection circuit 38 may be provided within the photosensitive drum as in this example or outside of the drum.

The current value is monitored by the controller 14, and when the value exceeds a predetermined value, it is judged that the transfer belt reaches the end of its lifespan and a signal representative of exchange of the belt can be issued or displayed on a display unit not shown. In this case, the drum 4 is stopped so that the cap 5 under the belt 29 in contact with the belt 29 or in a very narrow gap and the current detection circuit may detect an average current over one rotation of the belt or may detect a maximum value. The belt drive rollers 34*a*, 34*b* and 34*c* can be driven by a drive motor (not shown) in response to an instruction generated by the controller 14 which responds to a belt state detection command inputted therein. Further, the controller 14 may perform setting, adjustment and control of the power supply 31 for the charger 30 on the basis of a detected value of the current flowing in the cap 5. In addition, since the cap 5 is possibly in contact with the developing agent layer of the developer 12 by, for example, control of rotation of the developer roll 10, if a monitoring period is provided periodically or in response to an inspection command inputted to the controller 14 and the drum is stopped so that the cap 5 is opposed to the developing roller 10 of the developer 12, a voltage value of the bias voltage supply, optimization of a thickness of the developing agent layer and fatigue of the developing agent can be estimated by detecting the current flowing in the cap 5 from the bias voltage supply 13 by the current detection circuit 38. Further, when the drum is stopped so that the cap 5 is opposed to the charger 16 and the current flowing in the cap 5 from the charger 16 is detected by the current detection circuit 38, dirt of the wire of the charger and influence to the discharge can be estimated.

There is known a method of utilizing the developing agent (toner) withdrawn by the cleaner 28 again to attain low cost. In FIG. 10, a feedback system 39 serves to recycle the developing agent from the cleaner 28 to the developer 12. The recycled developing agent contains paper powder 40 mixed with toner. When an amount of paper powder is small, there is no problem, while as the amount of paper powder is increased, deterioration of the printing quality is remarkable. In this case, a phenomenon that a resistance of the developing agent layer is reduced as the amount of paper powder is increased is utilized to detect the current flowing in the cap 5 from the relative developing roll 10, so that the amount of paper powder contained in the developing agent in the developer can be estimated. Detection of the amount of paper powder contained in the developing agent in the developer can be performed by newly providing a separate current detection circuit 41 and detecting a current flowing in the current detection circuit 41 from the bias voltage supply 13 to thereby estimate the amount of paper powder. The current value detected at this time is supplied to the controller 14.

As described above, by using the cap 5 of the drum 4 as the current detection electrode, the life of the transfer belt, the life of the developing agent, the amount of paper powder contained in the developing agent and contamination state of the charger wire can be estimated.

Figure 11:
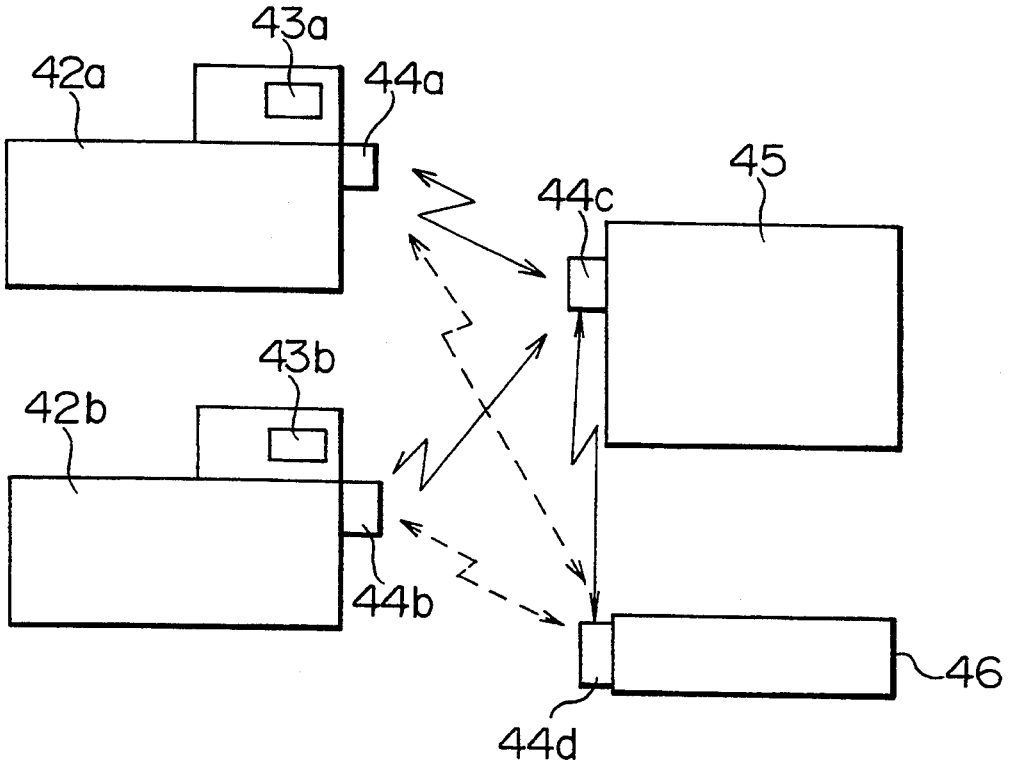
FIG. 11 schematically illustrates a diagnosis system for an electrostatic recording apparatus.

FIG. 11 schematically illustrates an online diagnosis system of the electrostatic recording apparatus. In FIG. 11, numerals 42*a* and 42*b* denote electrostatic recording apparatuses, 45 a central information processing unit installed in a control center for diagnosing the plurality of electrostatic recording apparatuses remotely, 46 a processing unit of a service center, 43*a* and 43*b* display units provided in the respective electrostatic recording apparatuses, and 44*a*, 44*b*, 44*c* and 44*d* transmitting and receiving or transceiver units. In FIG. 11, the central information processing unit 45 includes a computer and collects information such as states of mechanisms, the number of printed sheets of pager and a remaining amount of developing agent to process the information. Such information of the electrostatic recording apparatuses 42*a* and 42*b* may be displayed in the display units 43*a* and 43*b* by their controllers 14 or may be transmitted to the central information processing apparatus 45 through the transceiver units 44*a*, 44*b* and 44*c* and a communication medium (communication line). A diagnosis system of the electrostatic recording apparatus is described in U.S. patent application filed Jan. 29, 1992 as Rule 60 Continuation application of the above-cited U.S. Pat. No. 5,138,380. This application is incorporated herein by reference.

Information such as a jam of paper and a failure capable of being treated there is directly displayed on the display units 43*a* and 43*b*. A public communication line or a private communication line provided in a company can be used as the communication line.

Information relative to the states of mechanisms of the electrostatic recording apparatuses 42*a* and 42*b* involves a value of current flowing into the drum cap 5 from the belt for estimating the remaining life of the transfer belt 29, a value of current flowing into the drum cap 5 from the developer roll 10 for estimating the life of the developing agent and an amount of paper powder contained in the developing agent and a value of current flowing into the drum cap 5 from the charger 16. Further, information relative to the state of mechanism involves the surface potential of the photoconductor and variation of light intensity of the exposure system. The information is sent to the central information processing unit 45 through the transceiver units and the communication medium.

The central information processing unit 45 analyzes the information and performs statistical processing to estimate the life of the transfer belt 29, the life of the developing agent 21, the amount of paper powder contained in the developing agent, deterioration and contamination state of the wire of the charger, the life of the photoconductor 2 and the life of the exposure system such as LD and LED and diagnose troubles. The results thereof can be sent through the transceiver units 44*a*, 44*b*, 44*c* and 44*d* to the respective electrostatic recording apparatuses and displayed on the attached display units 43*a* and 43*b*. Further, the result can be sent from the central information processing unit 45 to the processing unit 46 at the service center and can cause a service man to go to a place where the electrostatic recording apparatus is installed for exchange of the transfer belt, the developing agent, the photoconductor, the charger wire, the LD and the LED and cleaning within the developer and the charger on the basis of the sent diagnosis information. Alternatively, when the periodical inspection is made or when any trouble is found in the data sent from an electrostatic recording apparatus, various inspection instructions can be sent from the central information processing unit 45 or the information processing unit 46 at the service center to the corresponding electrostatic recording apparatus and service can be made on the basis of the result thereof, so that effective service can be provided. In this case, if an identification data its adapted to be assigned to each of the electrostatic recording apparatuses and be held in the controller, each apparatus can be inspected in response to the corresponding inspection instructions.

The method of sending the state of mechanism of an electrostatic recording apparatus to the central information processing unit is classified as follows:

(a) Information of the mechanism state is sent from the electrostatic recording apparatus periodically, for example, once a day at a predetermined time.

(b) A judgment circuit is provided in the electrostatic recording apparatus and when a previously set value is exceeded, the information of the mechanism state is sent from the electrostatic recording apparatus to the central information processing unit.

(c) Information is sent at an arbitrary time by the user's decision of the electrostatic recording apparatus.

In the methods (a), (b) and (c), the electrostatic recording apparatus is the subject and the information is sent from the electrostatic recording apparatus to the central information processing unit.

(d) A signal representative of transmission of data is sent from the central information processing apparatus to the electrostatic recording apparatus upon the periodical inspection or the like and the electrostatic recording apparatus sends the information of the mechanism state to the central information processing unit in response to the signal.

Further, the central information processing unit may start the above operation in response to instructions from the service center.

The central information processing unit monitors the information sent thereto from the electrostatic recording apparatus and when the central information processing unit judges that more detailed information is required, the central information processing unit issues instructions to the electrostatic recording apparatus to send the information of the mechanism state including associated data so that the information is sent from the electrostatic recording apparatus to the central information processing unit.

Figure 13:
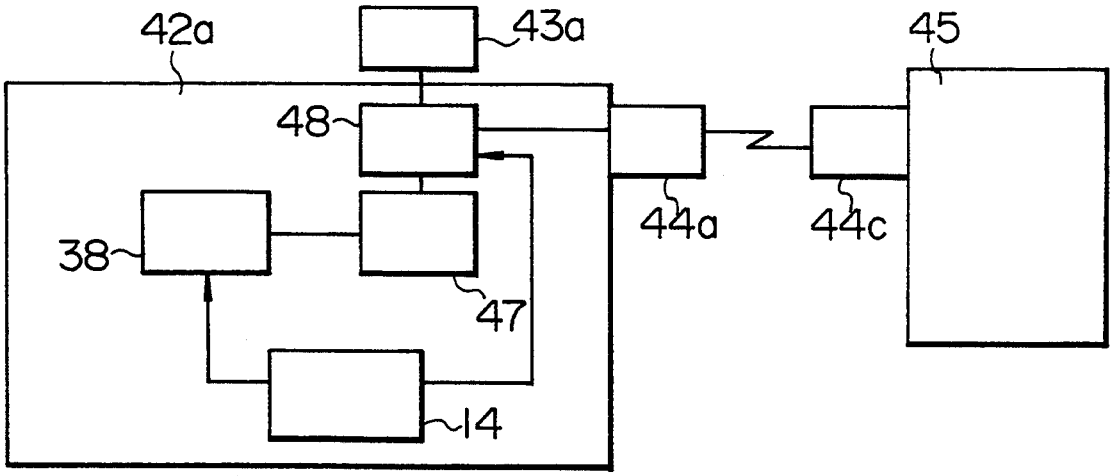
FIG. 13 is a block diagram schematically illustrating a system configuration required to obtain the data of the mechanism state of the electrostatic recording apparatus and transmit the data to the central information processing unit.

FIG. 13 is a block diagram schematically illustrating a system configuration required to obtain the information of the mechanism state of the electrostatic recording apparatus and transmit the information to the central information processing unit. The electrostatic recording apparatus 42*a* shown in FIG. 11 is used as its representative. A current detection circuit starts its operation in response to an instruction of the controller 14 and measured data is stored in a data storage (including an A/D converter, a memory and an operation unit). When a data judgment circuit 48 judges that any of values or ranges set previously for measured data is exceeded, the information including the measured data for an item exceeding the range is sent to the central information processing unit 45 through the transceiver unit 44*a* and the communication medium in accordance with an instruction of the controller 14.

Further, the information can be displayed on the display unit 43*a*, so that the contents of the information sent to the central information processing unit 45 can be confirmed.

As apparent from the foregoing description, according to the present invention, the following advantages are attained.

Since the capacitor connected to the cap is charged by the charger and the developing agent layer and the cap are separated from each other mechanically or electrically until the potential of the cap reaches the predetermined potential, the cap surface is not developed even if the potential at the cap is low. That is, toner is not attached.

When the photoconductor drum is suddenly stopped due to a jam of paper or a trouble of a printer, electric charge stored in the capacitor connected to the cap is removed. Accordingly, when an operator removes sheets of paper wound on the drum or examines the drum, the operator is not struck by electricity even if the operator comes into contact with the cap.

Since the photoconductive drum is stopped so that the cap is opposed to the charger, the capacitor connected to the cap can be rapidly charged by the charger when the apparatus is restarted after recovery of the trouble. Accordingly, the restarting (restoration) time can be made short.

When the belt transfer system is used as the transfer system, the belt can not be flawed by avoiding the cap edge from being pressed on the transfer belt during rotation of the drum.

Since the cap is positioned inside of ends of the drum, the roller for securing the developing gap can be moved on the drum ends and influence of the step between the cap and the drum can be avoided.

Since the cap of the drum can be used as the current measuring electrode and the current flowing in the cap from the transfer belt, the current flowing from the developer roller through the developing agent into the cap and the current flowing from the charger into the cap can be measured, the performance and the life of the transfer belt, the developing agent and the charger can be estimated without provision of a new electrode.

What is claimed is:

1. An electrostatic recording apparatus comprising:
a photosensitive drum including a cap provided in an opening of said drum and a photoconductor sheet wound on a portion of said drum except said opening;
rotation means for rotating said photosensitive drum;
position detection means for detecting a rotation position of said photosensitive drum;
a belt transfer system including a transfer belt for carrying a sheet of printing paper;
belt retraction means for selectively retracting said transfer belt; and
belt control means for controlling said belt retraction means such that said cap does not come into contact with said transfer belt in accordance with the rotation position of said photosensitive drum detected by said position detection means.

2. An electrostatic recording apparatus according to claim 1, further comprising:
belt electrifying means for electrifying said transfer belt during a printing operation; and
current detection means for detecting a current flowing in said cap, and wherein
said belt control means comprises:
means, responsive to an inputted belt inspection instruction, for controlling said rotation means to be stopped such that said cap is opposed to said transfer belt, controlling said belt retraction means so that said transfer belt comes into contact with said cap, and controlling said belt electrifying means so that a current flows in said cap through said transfer belt.

3. An electrostatic recording apparatus according to claim 2, further comprising:
judgment means for judging a state of said transfer belt in accordance with a current value detected by said current detection means and a predetermined current value.

4. An electrostatic recording apparatus according to claim 3, further comprising a display unit, and means for displaying a judgment result by said judgment means on said display unit.

5. An electrostatic recording apparatus according to claim 2, further comprising means for transmitting the current value detected by said current detection means to an external apparatus.

6. An electrostatic recording apparatus according to claim 1, further comprising development means for forming a toner image, and wherein said development means including a developer roll having rollers disposed on the both sides of said developer roll and having a diameter larger than that of said developer roll, for forming bristle of toner, at least a portion of said drum positioned on both sides of said drum and on which said photoconductor sheet is not wound being in contact with said rollers.

7. An electrostatic recording apparatus according to claim 6, wherein a dielectric film is formed on said at least portion of said drum on which said photoconductor sheet is not wound.

8. An electrostatic recording apparatus comprising:
a specific one of a plurality of constituent elements;
means for electrifying said specific constituent element;
a photoconductor drum including a cap provided in an opening of said drum and a photoconductor sheet wound on a portion of said drum except said opening;
current detection means connected to said cap, for detecting a value of current flowing from said electrifying means through said specific constituent element into said cap;
judgment means for judging a state of said specific constituent element in accordance with the detected current value and a predetermined current value for said specific constituent element; and
a belt transfer system including a transfer belt that carries a sheet of printing paper as said specific constituent element for carrying a sheet of printing paper;
wherein said current detection means detects the value of current flowing through said transfer belt from said electrifying means into said cap, and said judgment means judges whether said transfer belt reaches an end of its life span or not, in accordance with the detected current value and the predetermined current value.

9. An electrostatic recording apparatus comprising:
a photoconductor drum including a cap provided in an opening of said drum and a photoconductor sheet wound on a portion of said drum except said opening, said cap being electrified while said photoconductor drum is rotated;
potential detection means for detecting a potential of said cap;

development control means for controlling attachment of toner particles to said cap in accordance with the potential detected by said potential detection means;

developing means for forming a toner image on said photoconductor drum;

a transfer belt transferring a sheet of print paper; and transfer belt moving means for retracting said transfer belt while said developing means forms the toner image on said photoconductor drum and maintaining said transfer belt in close proximity to said photoconductor drum after formation of the toner image.

10. An electrostatic recording apparatus according to claim 9, wherein said transfer belt moving means includes rollers disposed apart from each other by a predetermined distance on a side opposing said photoconductor drum with respect to said transfer belt, a surface of each roller being coated with a dielectric film.

* * * * *

UNITED STATES PATENT AND TRADEMARK OFFICE

CERTIFICATE OF CORRECTION

PATENT NO. : 5,373,351

DATED : December 13, 1994

INVENTOR(S) : Tokao Umeda, et. al.

It is certified that error appears in the above-indentified patent and that said Letters Patent is hereby corrected as shown below:

| Column | Line | |
|---|---|---|
| 1 | 27 | Before "copying" change "the" to --type--. |
| 4 | 20 | Change "is" to --was--. |
| 4 | 21 | Change "is" to --was--. |
| 4 | 35 | Change "of" to --from--. |
| 4 | 40 | Change "are" to --were--. |
| 4 | 47 | Change "certainly" to --reliably--. |
| 6 | 59 | Delete "to be". |
| 6 | 68 | Change "surface-of" to --surface of--. |
| 8 | 22 | Before "merit" insert --the--. |
| 8 | 31 | Change "operable" to --openable--. |

UNITED STATES PATENT AND TRADEMARK OFFICE

CERTIFICATE OF CORRECTION

PATENT NO. : 5,373,351
DATED : December 13, 1994
INVENTOR(S) : Tokao Uneda, et. al.

It is certified that error appears in the above-indentified patent and that said Letters Patent is hereby corrected as shown below:

| Column | Line | |
|---|---|---|
| 9 | 33 | Change "to control" to --the control of--; change "is" to --are--. |
| 10 | 5 | Change "remained" to --remaining--. |
| 11 | 17 | Change "roller" to --rollers--. |
| 11 | 20 | After "rollers" insert --and--. |
| 12 | 6 | Change "representative of" to --for the--. |
| 14 | 3 | Change "its" to --is--. |
| 14 | 4 | After "and" insert --to--. |
| 14 | 30 | Change "periodical" to --periodic--. |

Signed and Sealed this

Thirtieth Day of May, 1995

*Attest:*

Bruce Lehman

BRUCE LEHMAN

*Attesting Officer*

*Commissioner of Patents and Trademarks*